US007976281B2

(12) United States Patent
Keith et al.

(10) Patent No.: US 7,976,281 B2
(45) Date of Patent: Jul. 12, 2011

(54) TURBINE ROTOR BLADE AND METHOD OF ASSEMBLING THE SAME

(75) Inventors: Sean Robert Keith, Fairfield, OH (US); Michael Joseph Danowski, Cincinnati, OH (US); Leslie Eugene Leeke, Jr., Burlington, KY (US)

(73) Assignee: General Electric Company, Schenectady, NY (US)

( * ) Notice: Subject to any disclaimer, the term of this patent is extended or adjusted under 35 U.S.C. 154(b) by 1086 days.

(21) Appl. No.: 11/748,571

(22) Filed: May 15, 2007

(65) Prior Publication Data

US 2008/0286109 A1 Nov. 20, 2008

(51) Int. Cl.
*F01D 5/18* (2006.01)
*F01D 5/30* (2006.01)

(52) U.S. Cl. ..... 416/193 A

(58) Field of Classification Search ..... 416/189, 416/190, 191, 193 A, 193 R, 196 R, 220 R, 416/239
See application file for complete search history.

(56) References Cited

U.S. PATENT DOCUMENTS

| | | | | |
|---|---|---|---|---|
| 3,393,862 | A | 7/1968 | Harrison | |
| 3,761,200 | A | 9/1973 | Gardiner | |
| 3,801,222 | A | 4/1974 | Violette | |
| 4,019,832 | A | 4/1977 | Salemme et al. | |
| 4,480,957 | A | 11/1984 | Patel et al. | |
| 4,483,661 | A | 11/1984 | Manharth | |
| 4,650,399 | A * | 3/1987 | Craig et al. | 416/97 R |
| 5,193,982 | A | 3/1993 | Inizan et al. | |
| 5,222,865 | A | 6/1993 | Corsmeier | |
| 5,281,096 | A | 1/1994 | Harris et al. | |
| 7,284,958 | B2 * | 10/2007 | Dundas et al. | 416/193 A |
| 2008/0286106 | A1 * | 11/2008 | Keith et al. | 416/193 A |

FOREIGN PATENT DOCUMENTS

| | | |
|---|---|---|
| EP | 1081337 A2 | 3/2001 |
| EP | 1881156 A2 | 1/2008 |
| EP | 1905950 A1 | 4/2008 |
| FR | 2544381 | 10/1984 |

OTHER PUBLICATIONS

European Search Report, EP08156067, dated Oct. 13, 2008, 9 pages.

* cited by examiner

*Primary Examiner* — Nathaniel Wiehe
(74) *Attorney, Agent, or Firm* — William Scott Andes, Esq.; Armstrong Teasdale LLP

(57) ABSTRACT

A rotor blade assembly includes a shank, an airfoil that is formed integrally with the shank, and a removable platform coupled between said shank and said airfoil via a friction fit. A method of assembling a gas turbine engine rotor blade assembly that includes a removable platform, and a gas turbine engine rotor assembly including the removable platform are also described herein.

14 Claims, 9 Drawing Sheets

TURBINE ROTOR BLADE AND METHOD OF ASSEMBLING THE SAME

BACKGROUND OF THE INVENTION

This application relates generally to gas turbine engines and, more particularly, to gas turbine engine rotor blades and a method of fabricating a turbine rotor blade.

FIG. 1 is a perspective view of a pair of known rotor blades that each include an airfoil 2, a platform 4, and a shank or dovetail 6. During fabrication, the known rotor blades are cast such that the platform is formed integrally with the airfoil and the shank. More specifically, the airfoil, the platform, and the shank are cast as a single unitary component.

During operation, because the airfoil is exposed to higher temperatures than the dovetail, temperature gradients may develop at the interface between the airfoil and the platform, and/or between the shank and the platform. Over time, thermal strain generated by such temperature gradients may induce compressive thermal stresses to the platform. Over time, the increased operating temperature of the platform may cause platform oxidation, platform cracking, and/or platform creep deflection, which may shorten the useful life of the rotor blade.

To facilitate reducing the effects of the high temperatures in the platform region, shank cavity air and/or a mixture of blade cooling air and shank cavity air is introduced into a region below the platform region using cooling passages to facilitate cooling the platform. However, the cooling passages may introduce a thermal gradient into the platform which may cause compressed stresses to occur on the upper surface of the platform region. Moreover, because the platform cooling holes are not accessible to each region of the platform, the cooling air may not be uniformly directed to all regions of the platform.

Since the platform is formed integrally with the dovetail and the shank, any damage that occurs to the platform generally results in the entire rotor blade being discarded, thus increasing the overall maintenance costs of the gas turbine engine.

BRIEF SUMMARY OF THE INVENTION

In one aspect, a method of assembling a gas turbine engine rotor blade assembly is provided. The method includes casting a rotor blade that includes a shank portion, an airfoil that is formed integrally with the shank portion, a first sidewall, a second sidewall joined to the first sidewall at a leading edge and at an axially-spaced trailing edge, and a platform portion that extends from the leading edge at least partially towards the trailing edge. The method also includes casting a removable platform and coupling the removable platform to the rotor blade using a friction fit.

In another aspect, a rotor blade is provided. The rotor blade includes a shank, an airfoil that is formed integrally with the shank, and a removable platform coupled between the shank and the airfoil via a friction fit.

In a further aspect, a rotor assembly is provided. The rotor assembly includes a rotor disk, and a plurality of circumferentially-spaced rotor blade assemblies coupled to the rotor disk. Each rotor blade assembly includes a shank, an airfoil that is formed integrally with the shank, and a removable platform friction fit between the shank and the airfoil.

DETAILED DESCRIPTION OF THE INVENTION

Figure 2:
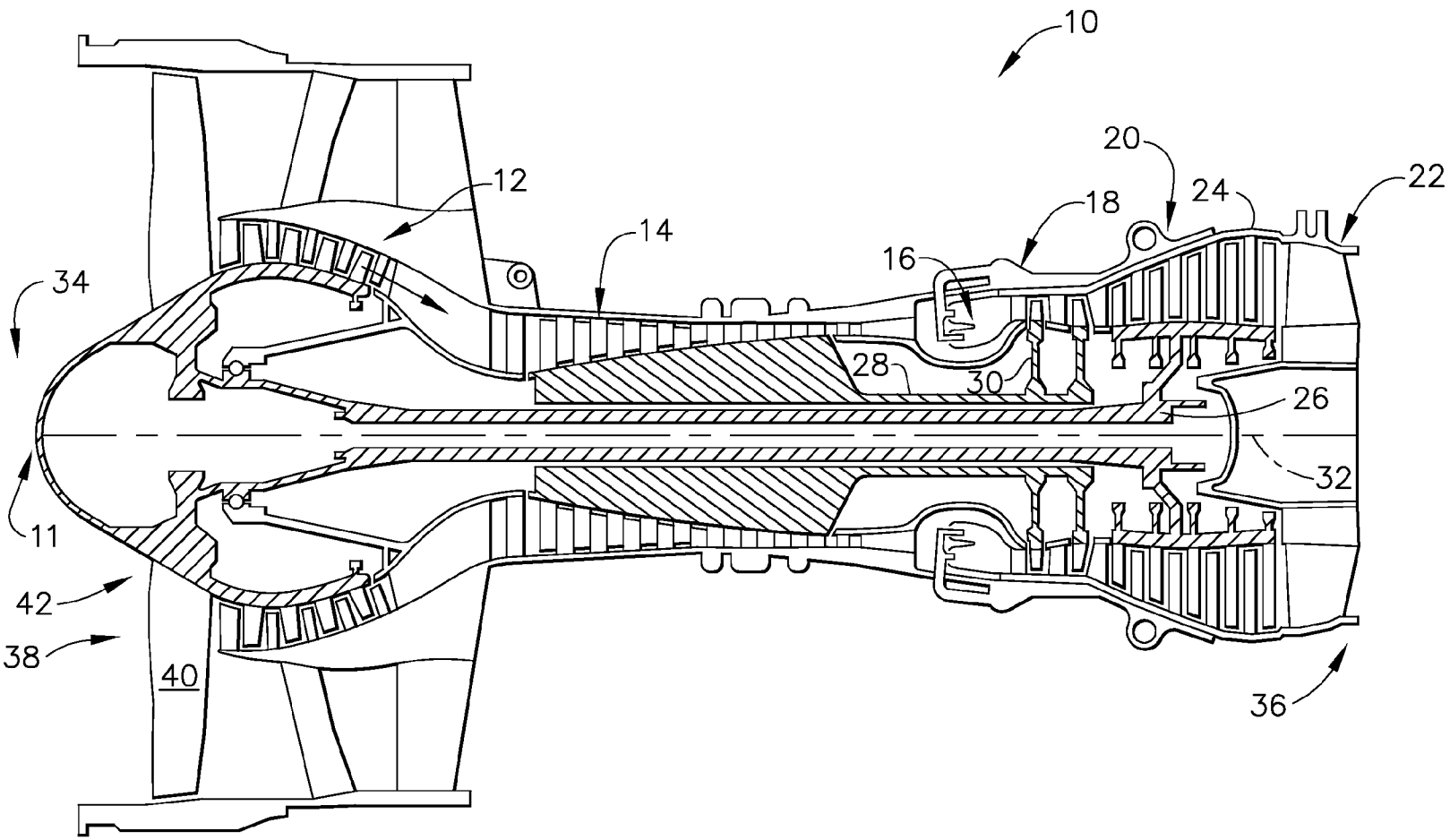
FIG. 2 is a schematic illustration of an exemplary gas turbine engine.

FIG. 2 is a schematic illustration of an exemplary gas turbine engine 10 that includes a fan assembly 11, a low-pressure compressor 12, a high-pressure compressor 14, and a combustor 16. Engine 10 also includes a high-pressure turbine (HPT) 18, a low-pressure turbine 20, an exhaust frame 22 and a casing 24. A first shaft 26 couples low-pressure compressor 12 to low-pressure turbine 20, and a second shaft 28 couples high-pressure compressor 14 to high-pressure turbine 18. Engine 10 has an axis of symmetry 32 extending from an upstream end 34 of engine 10 aft to a downstream end 36 of engine 10. Fan assembly 11 includes a fan 38, which includes at least one row of airfoil-shaped fan blades 40 attached to a hub member or disk 42.

In operation, air flows through low-pressure compressor 12 and compressed air is supplied to high-pressure compressor 14. Highly compressed air is delivered to combustor 16. Combustion gases from combustor 16 propel turbines 18 and 20. High pressure turbine 18 rotates second shaft 28 and high pressure compressor 14, while low pressure turbine 20 rotates first shaft 26 and low pressure compressor 12 about axis 32.

Figure 3:
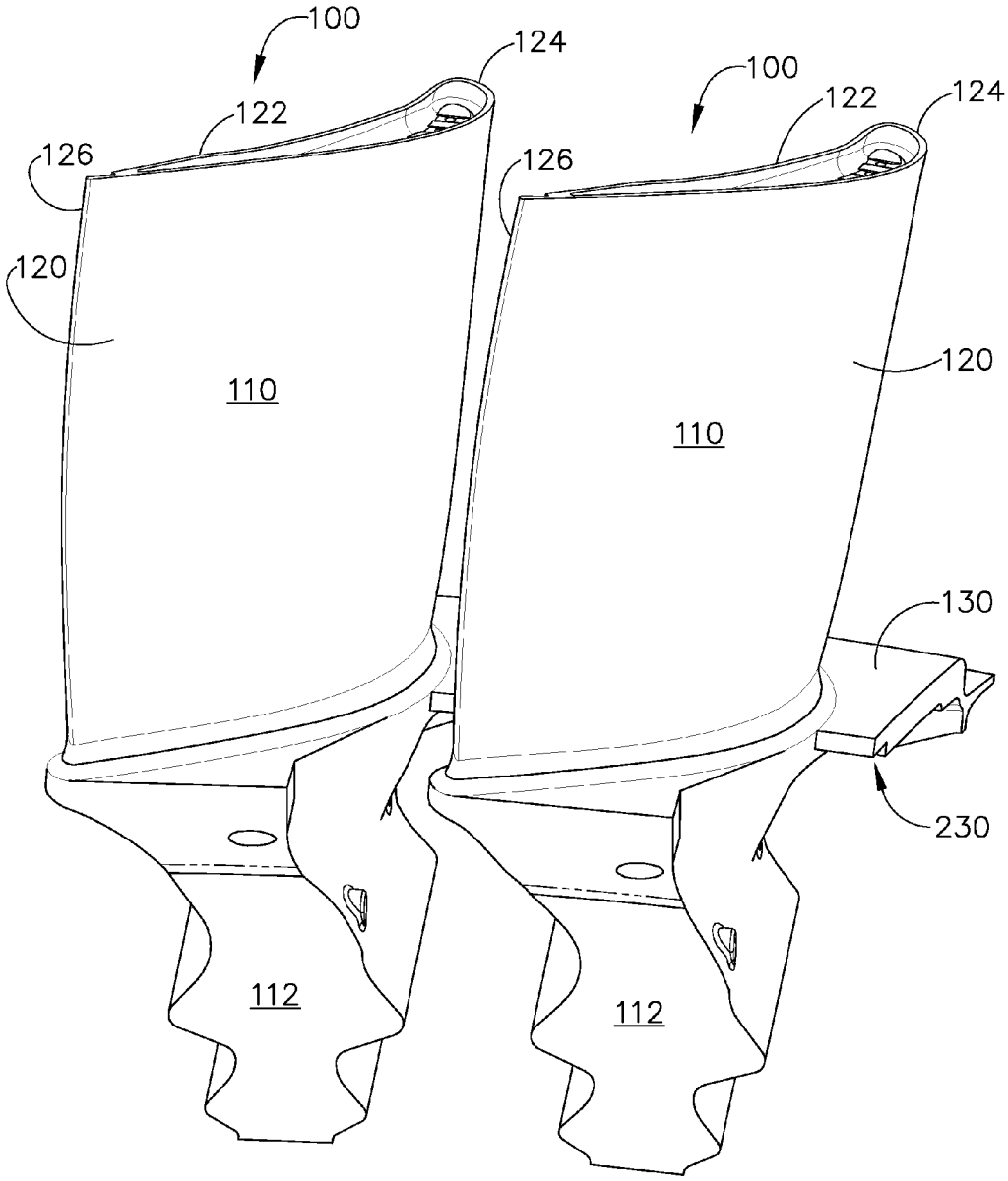
FIG. 3 is an enlarged perspective view of a pair of exemplary rotor blades that may be used with the gas turbine engine shown in FIG. 2.
Figure 4:
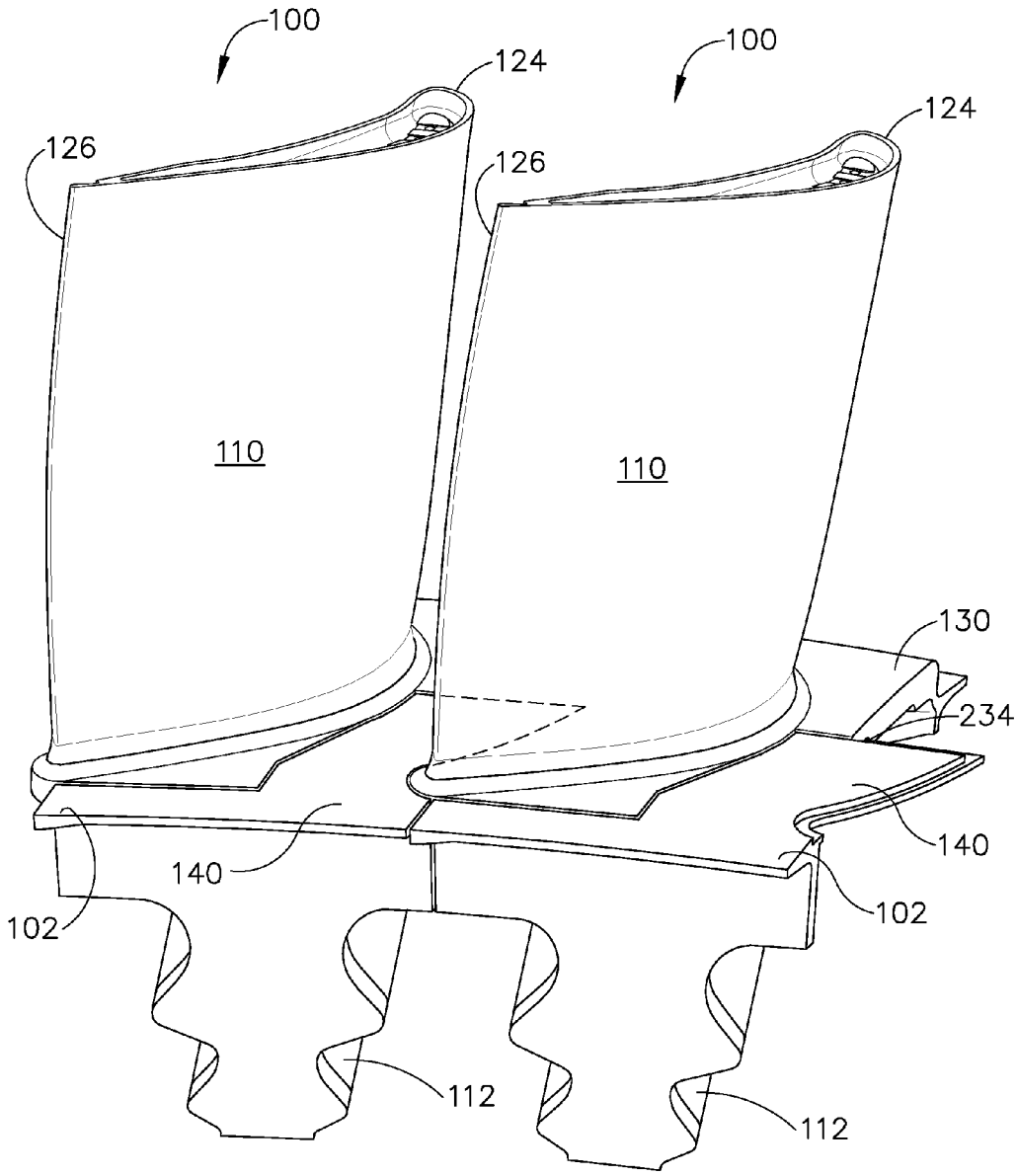
FIG. 4 is a perspective view of the exemplary rotor blades shown in FIG. 4 including a removable platform.
Figure 5:
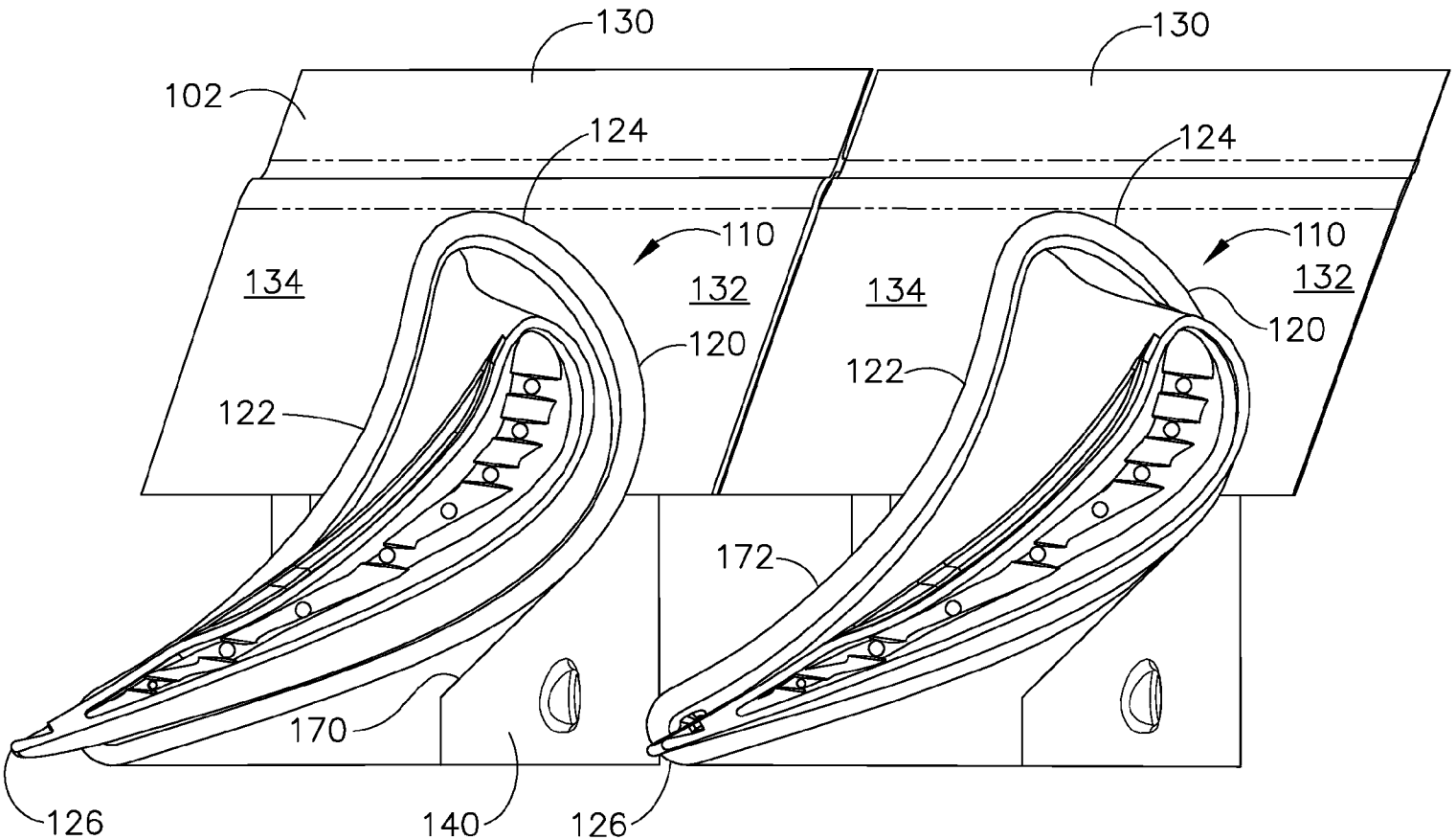
FIG. 5 is a top view on the exemplary rotor blades shown in FIGS. 3 and 4 including the removable platform.

FIG. 3 is an enlarged perspective view of a pair of exemplary rotor blades 100 that may be used with the gas turbine engine shown in FIG. 2. FIG. 4 is a perspective view of the exemplary rotor blades 100 shown in FIG. 4 including a removable platform 140. FIG. 5 is a top view on the exemplary rotor blades 100 shown in FIGS. 3 and 4 including the removable platform 140.

Figure 1:
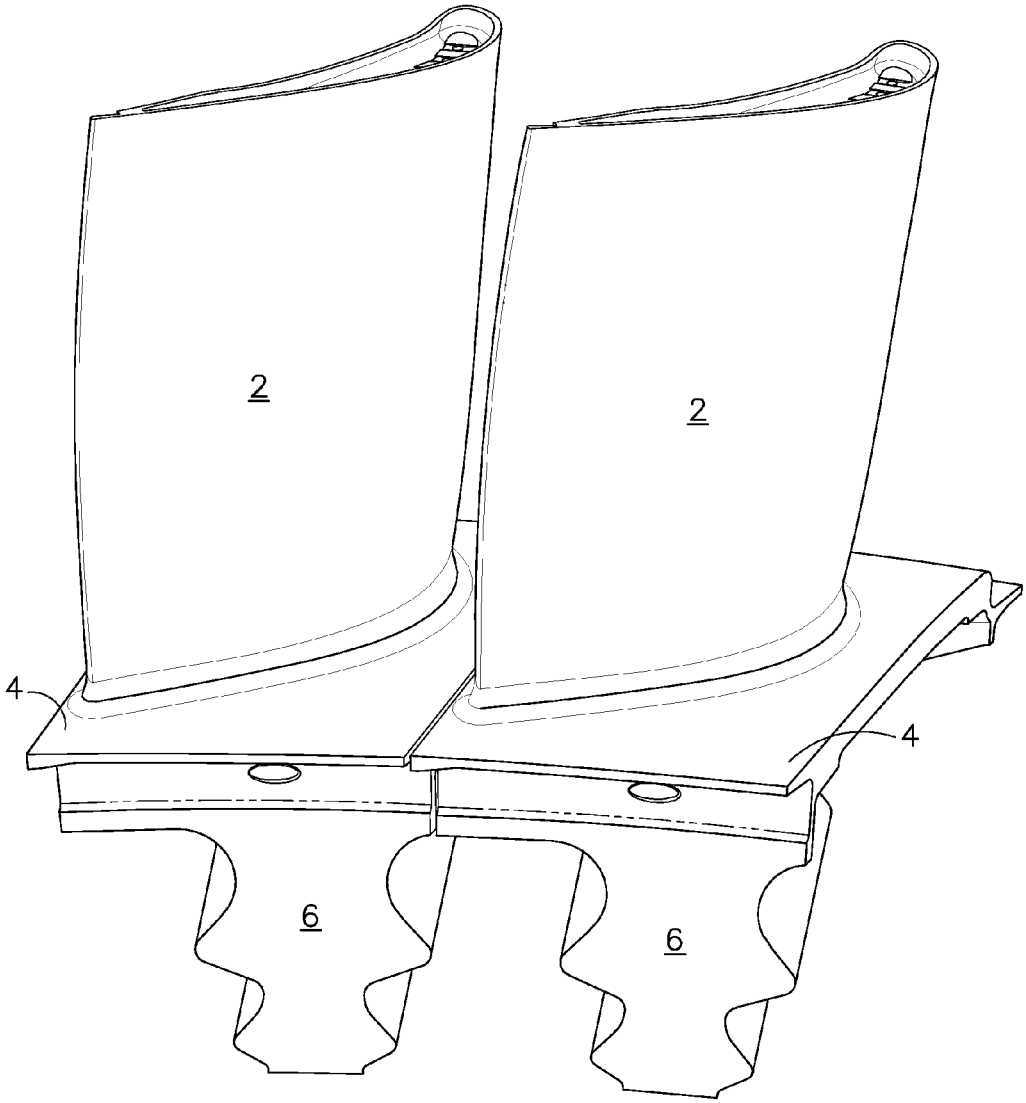
FIG. 1 (PRIOR ART)
FIG. 1 is a perspective view of a pair of known rotor blades.

In the exemplary embodiment, each rotor blade 100 has been modified to include the features described herein. When coupled within the rotor assembly, rotor blades 100 are coupled to a rotor disk, such as rotor disk 30 (shown in FIG. 1), that is rotatably coupled to a rotor shaft, such as shaft 28, for example. In an alternative embodiment, rotor blades 100 are mounted within a rotor spool (not shown). Each rotor blade 100 includes an airfoil 110 and a shank or dovetail 112 that is formed unitarily with airfoil 110.

Each airfoil 110 includes a first sidewall 120 and a second sidewall 122. First sidewall 120 is convex and defines a suction side of airfoil 110, and second sidewall 122 is concave and defines a pressure side of airfoil 110. Sidewalls 120 and 122 are joined together at a leading edge 124 and at an axially-spaced trailing edge 126 of airfoil 110. More specifically, airfoil trailing edge 126 is spaced chord-wise and downstream from airfoil leading edge 124.

Each rotor blade 100 also includes a platform portion 130 that, in the exemplary embodiment, is formed or cast unitarily with airfoil 110 and shank 112. As shown in FIG. 5, platform portion 130 extends from the leading edge 124 at least partially downstream towards the trailing edge 126. More specifically, platform portion 130 includes a first portion 132 that is coupled to the first sidewall 120 and extends from the leading edge 124 at least partially towards trailing edge 126, and a second portion 134 that is coupled to second sidewall 122 and extends from leading edge 124 at least partially towards trailing edge 126. In the exemplary embodiment, first and second portions 132 and 134 are formed or cast unitarily with airfoil 110 and shank 112

Each rotor blade 100 also includes a removable platform 140 that is removably coupled to rotor blade 100. More specifically, as discussed above, known rotor blades each include a platform that substantially circumscribes the rotor blade and is formed or cast as a unitary part of the airfoil and the shank. However, in this exemplary embodiment, rotor blades 100 do not include a platform that circumscribes the rotor blade and is formed permanently with the airfoil 110 and shank 112. Rather, as illustrated, each rotor blade 100 includes platform portion 130 and removable platform 140 that is coupled to rotor blade 100 such that the combination of platform portion 130 and removable platform 140 substantially circumscribe rotor blade 100.

Removable, as described herein is defined as a component that is not permanently attached to the rotor blades by either casting the platform unitarily with the airfoil and shank, or using a welding or brazing procedure for example, to attach the platform to the airfoil and/or shank. Rather the component, i.e. removable platform 140, is friction fit to rotor blade 100 or mechanically attached to rotor blade 100 to enable the platform 140 to be removed from the rotor blade 100 without removing, damaging, modifying, or changing the structural integrity of rotor blade 100 or platform portion 130.

Figure 6:
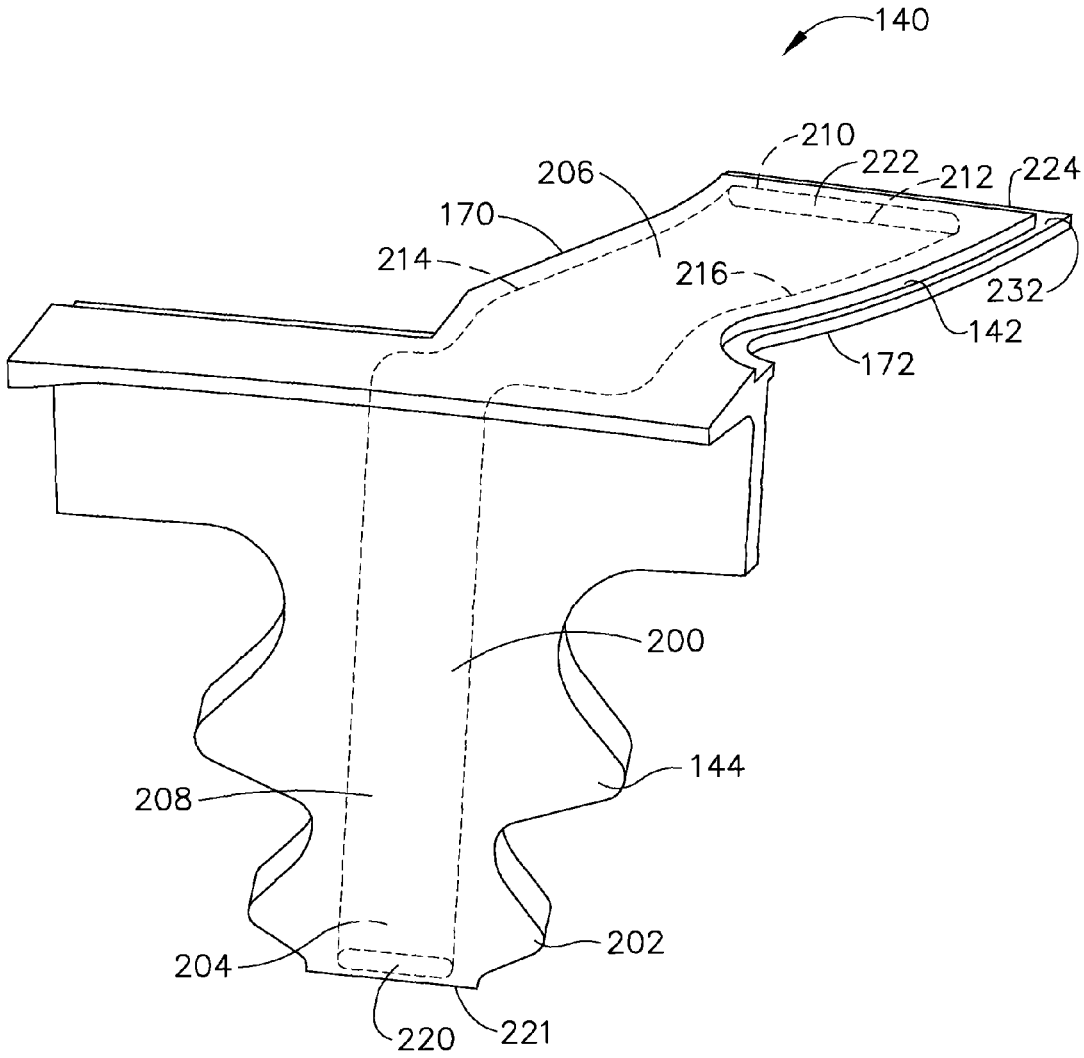
FIG. 6 is a perspective view of removable platform shown in FIGS. 3, 4, and 5.
Figure 7:
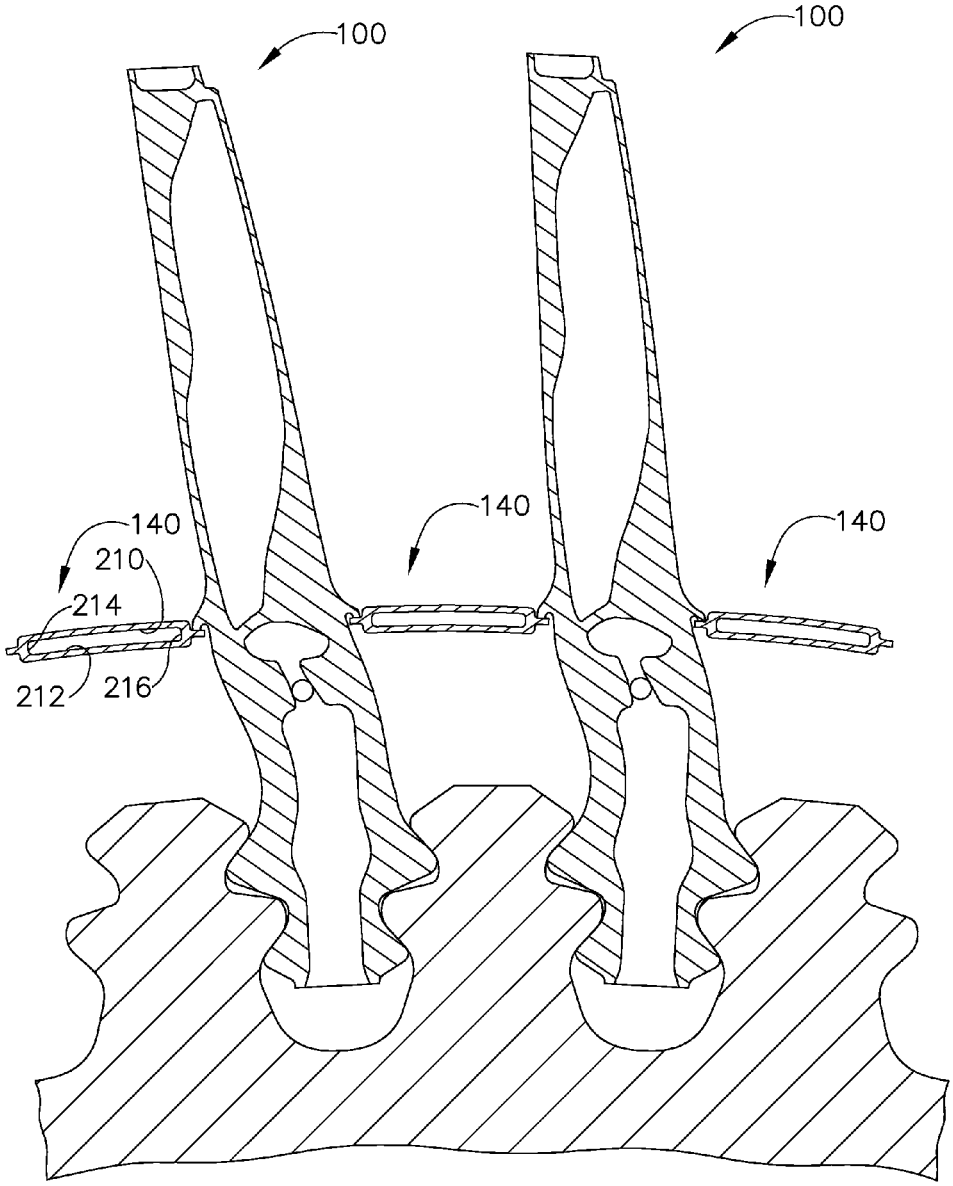
FIG. 7 is side view of a rotor blade and the removable platform shown in FIG. 6.

FIG. 6 is a perspective view of removable platform 140. As shown in FIG. 6, removable platform 140 includes a platform 142 and a shank 144 that is coupled to the platform 142. FIG. 7 is a cross-sectional view of rotor blade 100 and removable platform 140. In the exemplary embodiment, platform 142 and shank 144 are cast as a single unit to form a unitary removable platform 140. As shown in FIG. 4, shank 144 has a cross-sectional profile that is substantially the same as a cross-sectional profile of rotor blade shank 112. As such, the removable platform 140 may be positioned in the same rotor slot that is utilized to a retain rotor blade such as the rotor blades shown in FIG. 1. More specifically, although not shown, rotor disks generally include a plurality of slots, wherein each slot is utilized to retain a single rotor blade. Moreover, the slot has a width that is substantially similar to the width of the known rotor blade. However, in this embodiment, the combined widths of rotor blade shank 112 and removable platform shank 144 are substantially similar to the total width of the known rotor blade shank to enable, both the rotor blade 100 and shank 144 to be secured within a single rotor disk slot and thus enable the removable platform 140 to be retained within the rotor disk 30 via shank 144 which functions as the removable platform retainer.

As shown in FIGS. 5 and 6, removable platform 140 has a first edge 170 that is disposed proximate to sidewall 120 of rotor blade 100. As such, first edge 170 has a profile that substantially mirrors the profile of first sidewall 120. For example, since first sidewall 120 has a convex profile, platform first edge 170 is fabricated to have a concave profile. Moreover, platform portion 140 has a second edge 172 that is disposed proximate to sidewall 122 of a second rotor blade 100 that is positioned adjacent to the first rotor blade 100. As such, second edge 172 has a profile that substantially mirrors the profile of second sidewall 122. For example, since second sidewall 122 has a concave profile, second edge 172 is fabricated to have a substantially convex profile.

In one exemplary embodiment, shown in FIG. 6, removable platform 140 may also include a cast-in plenum 200 that is formed integrally within at least a portion of removable platform 140. Removable platform 140 includes outer surface 202 and an inner surface 204 that defines cast-in plenum 200. More specifically, following casting and coring of removable platform 140, inner surface 204 defines cast-in plenum 200 entirely within outer surface 202. Accordingly, in the exemplary embodiment, cast-in plenum 200 is formed unitarily with and completely enclosed within removable platform 140.

Cast-in plenum 200 includes a first plenum portion 206 and a second plenum portion 208 that is formed in flow communication with first plenum portion 206. As shown in FIG. 7, first plenum portion 206 includes an upper surface 210, a lower surface 212, a first side 214, and a second side 216 that are each defined by inner surface 204. In the exemplary embodiment, first side 214 has a generally concave shape that substantially mirrors a contour of platform first edge 170 and second side 216 has a generally convex shape that substantially mirrors a contour of platform second edge 172. Second plenum portion 208 extends from a lower surface 221 of shank/dovetail 144 to first plenum portion 206. More specifically, second plenum portion 208 includes an opening 220 that extends through shank 144 such that airflow channeled through opening 220 is channeled through both second plenum portion 208, through first plenum portion 206 and then discharged through a second opening 222 defined in an end 224 of first plenum 206. In operation, cooling airflow may then be channeled through the removable platform and directed onto a surface of platform portion 130 to facilitate cooling platform portion 130 and also to facilitate reducing the operating temperature of removable platform 140.

Figure 8:
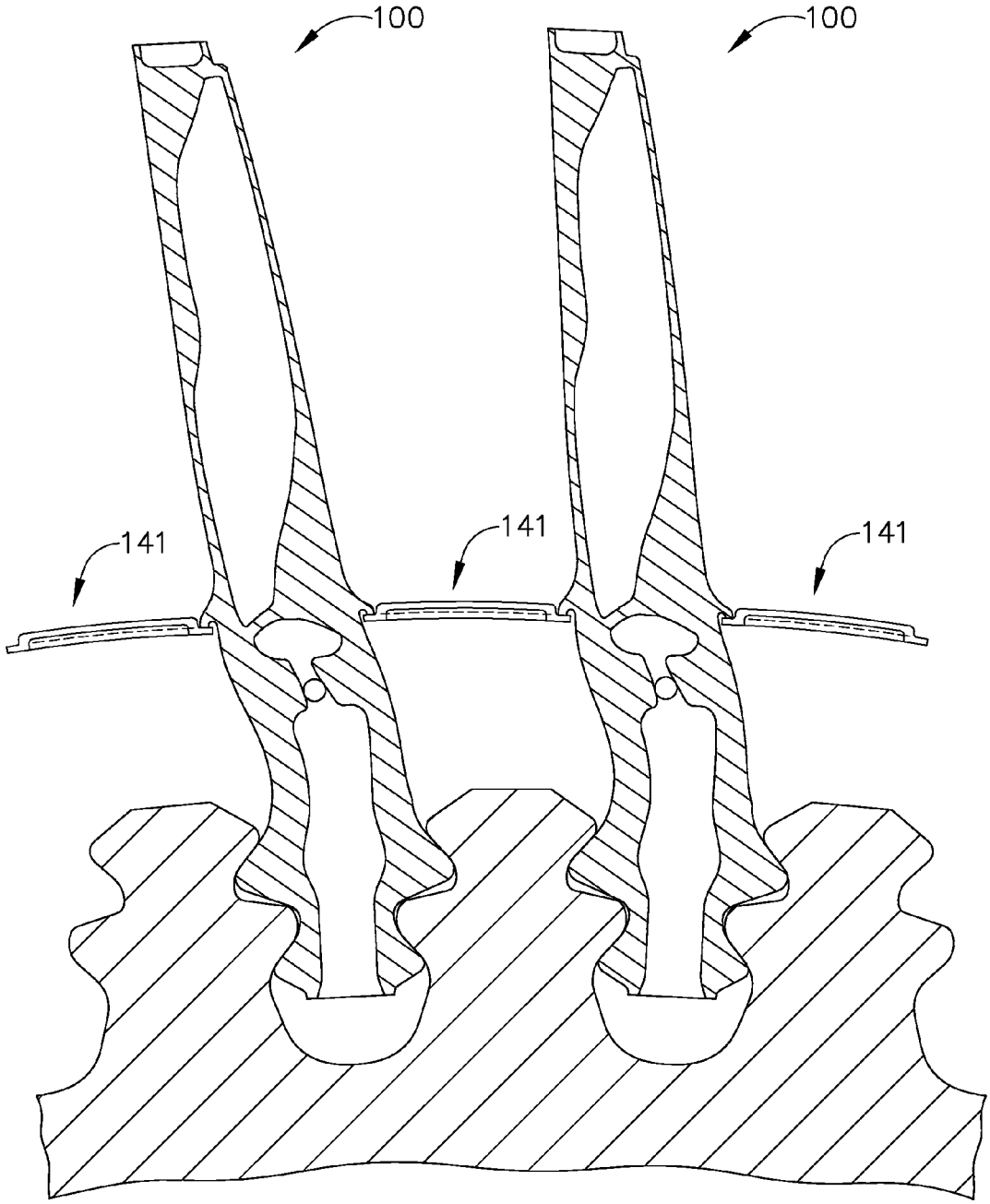
FIG. 8 is cross-sectional view of another exemplary removable platform.

FIG. 8 is cross-sectional view of another exemplary removable platform 141. As shown in FIG. 8, removable platform 141 is substantially similar to removable platform 140, however removable platform 141 does not include cast-in plenum 200. In this embodiment, removable platform 141 is formed from a substantially solid material and as such does not include any voids or openings that are intentionally formed or cast within removable platform 141

In use, removable platforms 140 and 141 are each configured to couple to and cooperate with platform portion 130. More specifically, as shown in FIGS. 3 and 6 platform portion 130 includes an edge or lap 230 and removable platform 140 includes an edge or lap 232 that is configured to couple with edge 230 to form a lap joint 234 shown in FIG. 4. As such, the combination of lap joint 234 and shank 114 facilitate securing removable platform 140 to rotor blade 100.

To assemble an exemplary turbine rotor, such as rotor 30, a first rotor blade 100 is installed in a first disk slot (not shown). A second rotor blade 100 is then installed in an adjacent disk slot (not shown). As discussed above, the disk slots are machined or cast to form a profile that is substantially similar to the profile of rotor blade shank 112 and removable platform shank 144 to enable each respective rotor blade to be retained within each respective slot. Removable platform shank 144 is then installed into the same respective rotor slot as the respective rotor blade in which removable platform 144 is coupled to, and edges 230 and 232 are overlapped to form lap joint 234. During engine operation, removable platform 140 is configured to be moveable between adjacent rotor blades.

Figure 9:
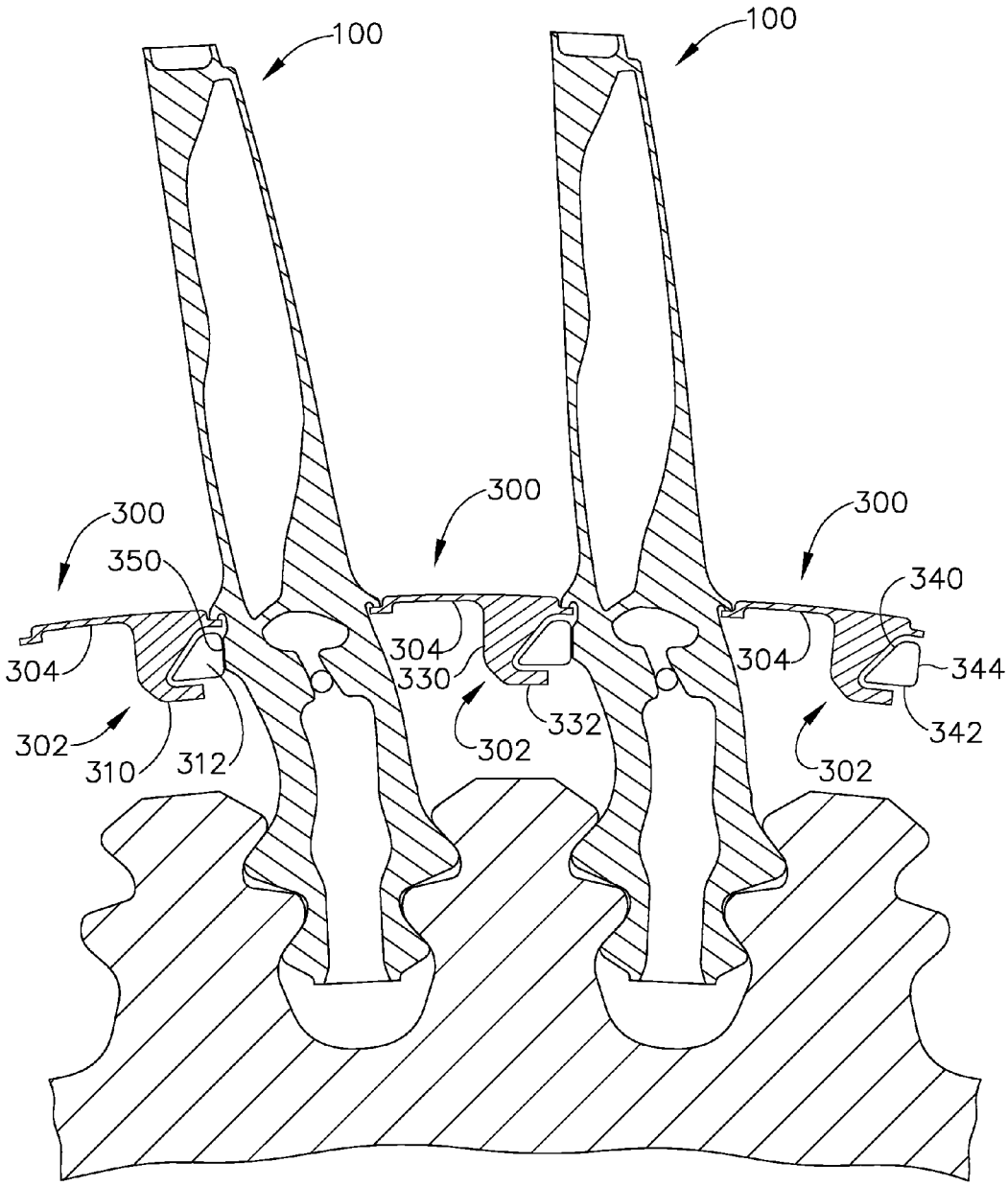
FIG. 9 is a cross-sectional view of an exemplary blade damper assembly.

FIG. 9 is a side view of another exemplary removable platform 300. Removable platform 300 is substantially similar to removable platforms 140 and 141 and may also include a damper assembly 302 that is coupled to a lower surface 304 of removable platform 300. In the exemplary embodiment, damper assembly 302 includes a damper retainer 310 and a damper 312 that is held in place by damper retainer 310. Damper retainer 310 is coupled to or formed unitarily with removable platform 300. More specifically, damper retainer 310 has a substantially L-shaped cross-sectional profile and includes a side portion 330 and a bottom portion 332 each of which are utilized to secure damper 312 between damper retainer 310 and rotor blade 100. As shown in FIG. 9, damper 312 has a first side 340 that has a profile that substantially mirrors a profile of side portion 330, a second side 342 that has a profile that substantially mirrors a profile of bottom portion 332, and a third side 344 that substantially mirrors a profile of a portion of rotor blade 100. More specifically, rotor blade 100 includes a substantially flat surface 350 that extends radially outwardly from the rotor blade 100 and is configured to provide a substantially flat surface to retain damper 312.

In operation, as the disk rotates, the plurality of rotor blades 100 also rotate. During some selected operating conditions, this rotation may cause a resonant vibration to occur at some given frequency. As such, this vibration is transmitted from the rotor blade 100 through the damper 312 wherein the resonant frequency is altered by damper 312. Accordingly, the dampers 312 facilitate reducing and/or eliminating resonant vibrations from occurring throughout the rotor disk.

Described herein is a new approach to platform design. The platform described is fabricated separately and is coupled to the rotor blade. The platform may be fabricated from the same material as the blade or from any other suitable material, including less costly materials and/or lighter materials. The platform is carried by the rotor disk and also the platform portion that is formed with the rotor blade. The platform may also be configured as a damper or may be configured to carry a damper.

As a result, the platform is free to expand and contract under engine operating thermal conditions, resulting in an elimination of platform and airfoil fillet distress. Specifically, the platform is free to expand and contract under engine operating thermal conditions, resulting in reduced platform stresses, and allowing for the use of less costly or lighter materials, or materials that have special temperature capability without strength requirements. The platform is a separate piece and is replaceable, disposable at overhaul, resulting in reduced scrap and maintenance cost, and facilitates cored platform cooling options.

Exemplary embodiments of rotor blades and rotor assemblies are described above in detail. The rotor blades are not limited to the specific embodiments described herein, but rather, components of each rotor blade may be utilized independently and separately from other components described herein. For example, the removable platforms described herein may be utilized on a wide variety of rotor blades, and is not limited to practice with only rotor blade 100 as described herein. Rather, the present invention can be implemented and utilized in connection with many other blade configurations. For example, the methods and apparatus can be equally applied to stator vanes or rotor blades utilized in steam turbines for example.

While the invention has been described in terms of various specific embodiments, those skilled in the art will recognize that the invention can be practiced with modification within the spirit and scope of the claims.

What is claimed is:

1. A method of assembling a gas turbine engine rotor blade assembly, said method comprising:

casting a rotor blade that includes a shank portion, an airfoil that is formed integrally with the shank portion, a first sidewall, a second sidewall joined to the first sidewall at a leading edge and at an axially-spaced trailing edge, and a platform portion that extends from the leading edge at least partially towards the trailing edge;

casting a removable platform that includes:

a shank portion formed unitarily with the removable platform, the shank portion configured to be positioned at least partially within a slot formed in a rotor assembly; and a cast-in plenum defined within the removable platform and the shank portion, the cast-in plenum having an exit positioned in flow communication with the platform portion and an entrance positioned in flow communication with a shank portion lower surface; and coupling the removable platform to the rotor blade using a friction fit.

2. A method in accordance with claim 1, wherein coupling the removable platform to the rotor blade comprises coupling the removable platform to the rotor blade such that the removable platform extends from the platform portion to the axially-spaced trailing edge.

3. A method in accordance with claim 2, wherein coupling the removable platform to the rotor blade further comprises coupling the removable platform to the platform portion of the rotor blade using a lap joint.

4. A method in accordance with claim 1, wherein coupling the removable platform to the rotor blade further comprises coupling a removable platform that includes a damper assembly to the rotor blade.

5. A rotor blade assembly comprising:

a shank;

an airfoil that is formed integrally with said shank;

a removable platform coupled between said shank and said airfoil via a friction fit, said removable platform comprising:

a platform portion; and a shank portion formed unitarily with said platform portion, said shank portion having a cross-sectional profile that is substantially similar to a cross-sectional profile of said rotor blade shank; and a cast-in plenum defined within said platform portion and said shank portion, said cast-in plenum having an exit positioned in flow communication with said platform portion and an entrance positioned in flow communication with a cooling air source.

6. A rotor blade assembly in accordance with claim 5 wherein said airfoil comprises a first sidewall and a second sidewall each joined together at a leading edge and at an axially-spaced trailing edge, said rotor blade assembly further comprising a platform portion that is formed integrally with said shank and said airfoil, said platform portion extending from said leading edge at least partially towards said trailing edge, said removable platform extending from said platform portion to said axially-spaced trailing edge.

7. A rotor blade assembly in accordance with claim 6, further comprising a lap joint configured to couple said removable platform to said platform portion.

8. A rotor blade assembly in accordance with claim 5, wherein said removable platform comprises:

a platform portion and a shank portion formed unitarily with the platform portion, the shank portion configured to be positioned at least partially within a slot formed in a rotor assembly.

9. A rotor blade assembly in accordance with claim 5, wherein said removable platform further comprises a damper assembly configured to reduce a vibrational frequency of said rotor blade assembly.

10. A rotor assembly in accordance with claim 5, wherein said removable platform further comprises:

a first edge having a profile that substantially mirrors a profile of a first rotor blade downstream side; and a second edge having a profile that substantially mirrors a profile of a second rotor blade upstream side, said second rotor blade coupled adjacent to said first rotor blade.

11. A gas turbine engine rotor assembly comprising:

a rotor disk; and a plurality of circumferentially-spaced rotor blade assemblies coupled to said rotor disk, each said rotor blade assembly comprising a shank;

an airfoil that is formed integrally with said shank portion; and a removable platform friction fit between said shank and said airfoil, said removable platform comprising:

a platform portion;

a shank portion formed unitarily with said platform portion, said shank portion configured to be positioned at least partially within a slot formed in a rotor assembly, said shank portion having a cross-sectional profile that is substantially similar to a cross-sectional profile of said rotor blade shank; and a cast-in plenum defined within the platform portion and the shank portion, said cast-in plenum having an exit positioned in flow communication with the platform portion and an entrance positioned in flow communication with a cooling air source.

12. A gas turbine engine rotor assembly in accordance with claim 11 wherein said airfoil comprises a first sidewall and a second sidewall each joined together at a leading edge and at an axially-spaced trailing edge, said rotor blade assembly further comprising a platform portion that is formed integrally with said shank and said airfoil, said platform portion extending from said leading edge at least partially towards said trailing edge, said removable platform extending from said platform portion to said axially-spaced trailing edge.

13. A gas turbine engine rotor assembly in accordance with claim 12, wherein said rotor blade assembly further comprises a lap joint configured to couple said removable platform to said platform portion.

14. A gas turbine engine rotor assembly in accordance with claim 11, wherein said removable platform further comprises a damper assembly configured to reduce a vibrational frequency of said rotor blade assembly.

* * * * *